US009481076B2

(12) United States Patent
Balota

(10) Patent No.: US 9,481,076 B2
(45) Date of Patent: Nov. 1, 2016

(54) DEVICE FOR SCREWING AND UNSCREWING BOLTS/NUTS

(71) Applicant: Adrian Balota, Suffolk, VA (US)

(72) Inventor: Adrian Balota, Suffolk, VA (US)

( * ) Notice: Subject to any disclaimer, the term of this patent is extended or adjusted under 35 U.S.C. 154(b) by 191 days.

(21) Appl. No.: 14/456,060

(22) Filed: Aug. 11, 2014

(65) Prior Publication Data

US 2016/0039073 A1 Feb. 11, 2016

(51) Int. Cl.
*B25B 13/18* (2006.01)
*B25B 13/32* (2006.01)
*B25B 13/12* (2006.01)

(52) U.S. Cl.
CPC ..... *B25B 13/18* (2013.01); *B25B 13/12* (2013.01)

(58) Field of Classification Search
CPC ..... B25B 13/18; B25B 13/12
USPC ..... 81/126–128, 90.1–90.3, 91.1–91.3
See application file for complete search history.

(56) References Cited

U.S. PATENT DOCUMENTS 891,257 A * 6/1908 Hope et al. ..... B25B 13/12 81/126
1,371,679 A * 3/1921 Happy ..... B25B 13/18 81/126
1,469,630 A * 10/1923 Harold ..... B25B 13/12 81/126
1,507,197 A * 9/1924 Albert ..... B25B 13/12 81/126
1,577,805 A * 3/1926 Albert ..... B25B 13/12 81/126

* cited by examiner

*Primary Examiner* — Hadi Shakeri

(57) ABSTRACT

Device for screwing and unscrewing bolts/nuts including a lever, two jaws mounted between two side plates, with spacers guiding and holding the components together, the lever rotates a certain angle around an axis moving the two jaws inward to clutch the bolt head/nut or outward to release the bolt head/nut.

2 Claims, 3 Drawing Sheets

Exploded View

General View

Exploded View

Maximum Open

Minimum Open

DEVICE FOR SCREWING AND UNSCREWING BOLTS/NUTS

The present invention relates to a hand device used for screwing and unscrewing screws bolts, nuts and the like.

The device as described below has a simple construction comprising a middle lever, two jaws mounted between two side plates, with spacers guiding and holding the components together. The said middle lever has two pins that move the said jaws in opposite direction when is rotated.

PRIOR ART

To screw/unscrew bolts/nuts the technicians usually use many time open-end wrenches. The operation has frequent interruptions do to the impossibility to rotate the tool continuously process that takes long time. They have to change the position of the wrench every rotation. Usually the technician turn the wrench about a third of a full rotation (120°). To screw a part having as little as 10 threads the technician has to retract, change the position and replace the tool for as much as 30 times.

PRESENT INVENTION

The object of the present invention is to provide a device to screw bolts/nuts without interruptions eliminating the need to reposition the wrench every turn and so reducing considerably the time necessary for this operation.

The same device can be used to screw/unscrew different fastener shapes: hexagonal, squared, octagonal, etc., and different fasteners size.

One of the novelties of the present invention consists in simplicity of its construction. There are multiple ways to build such a device using a large variety of materials, shapes and techniques. The drawings associated with this description give a better understanding of the construction and functionality of the device.

THE DESCRIPTION OF THE DRAWINGS

Figure 1:
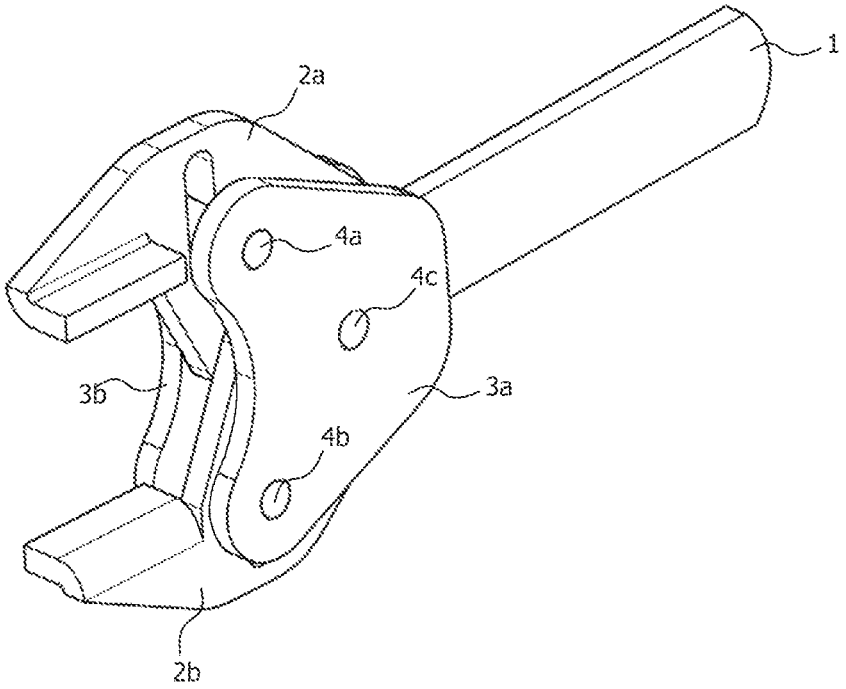
FIG. 1 is a general view of the device
Figure 2:
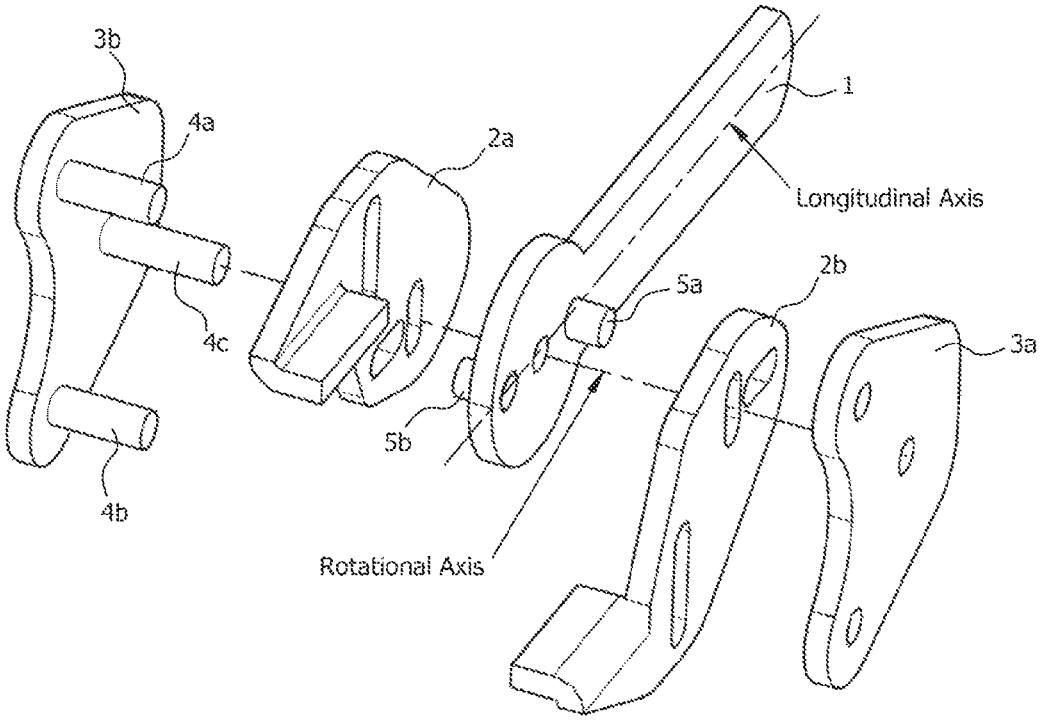
FIG. 2 is an exploded view
Figure 3:
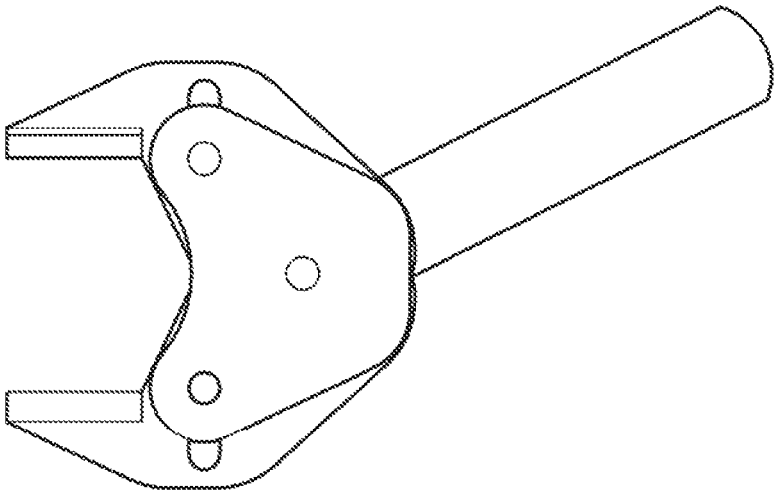
FIG. 3 shows the maximum opening of the device
Figure 4:
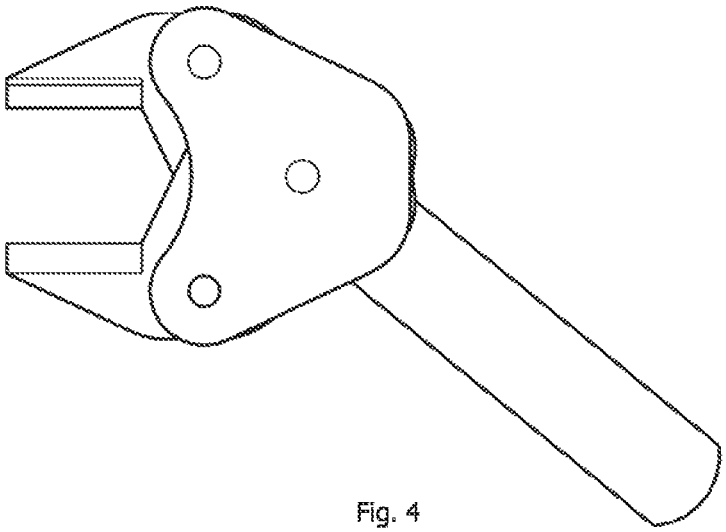
FIG. 4 shows the minimum opening of the device

The device for screwing and unscrewing bolts/nuts conform with the exploded view on FIG. 2 consists of a middle lever (1), two jaws (2*a*, 2*b*) mounted between two side plates (3*a*, 3*b*), with spacers (4*a*, 4*b* and 4*c*) that guide and hold together the components.

The said middle lever (1) has a hole in the center of its round shape and two pins (5*a*, 5*b*) placed one each face, equally distanced to the center, perpendicular to the longitudinal axis of the part. The pins are solid connected to the middle lever (welded, pressed, etc.).

The two jaws 2*a* and 2*b* are placed on the right side and the left side of the middle lever respectively. They are the parts that will be in contact with the bolt/screw. Both jaws have two vertical and one horizontal obround (slotted) holes. The vertical obround holes serve as a guide for the movement of the jaws.

The said side plates (3*a*, 3*b*), placed on the left and right of the device hold together the whole components. In this example the three spacers (4*a*, 4*b* and 4*c*) are solid connected to both 3*a* and 3*b* sides (welded, pressed, etc.). All three spacers serve also as guide for the movement of the jaws.

The upper spacer (4*a*), connected to the right side plate (3*b*), goes through the vertical upper hole of the right jaw (2*a*) then connects to the left side plate (3*a*). The lower spacer (4*b*), connected to the right side plate (3*b*), goes through the vertical lower hole of the left jaw (2*b*) then connects to the left side plate (3*a*). The central spacer (4*c*) connected to the right side plate (3*b*), goes through the central vertical obround hole in right jaw (2*a*), through the central hole in the middle lever (1), through the central vertical obround hole in the left jaw (2*b*), then connects to the left side plate (3*a*). Spacer (4*c*) serves also as rotation axle for the middle lever. The pin 5*a* on the middle lever goes through the horizontal obround hole in the left jaw (2*b*) and the pin (5*b*) goes through the horizontal obround hole in the right jaw (2*a*). The length of the pins is not exceeding the thickness of the jaws.

The device acts like a ratchet wrench. By rotating the middle lever the pins move the two jaws inward or outward. To screw or unscrew a bolt/nut the operator place the device on the bolt head/nut and rotates the lever. The jaws moves inward, clutches the bolt head/nut. At this point the device is tight connected to the bolt head/nut and will rotate—within a certain angle—with the movement of the lever screwing it or unscrewing it. Then, without retracting the device out from the bolt/nut axis, the operator rotates the device in opposite direction, to disengage the jaws. The jaws move outward and the bolt/nut is released. Next the operator continue to rotate the lever to a convenient angle to redo the screwing/unscrewing sequence. The entire screwing/unscrewing process is done without retracting the device out from the bolt/nut axis. To screw or unscrew a part the device needs to be turned 180 degree along with its longitudinal axis.

The length of the obround holes in the jaws will determine how much the lever will move and how much the jaws will open and close.

REFERENCES

U.S. Pat. No. 5,016,503 May 21, 1991—Carlyle d. Morton

U.S. Pat. No. 5,768,958 Jun. 23, 1998—Bruce H. Gamble

U.S. Pat. No. 6,151,996 Nov. 28, 2000—Carlton I. Whiteford

U.S. Pat. No. 6,810,773 Nov. 2, 2004—Frank Trucchio

U.S. Pat. No. 7,895,920 May 1, 2011—Hani A. Abunamech

The invention claimed is:

1. A device for screwing or unscrewing fastener elements comprising:

a middle lever defining a handle having a longitudinal axis and a head having two opposite faces;

two jaws with one placed on each side of said middle lever;

two side plates with one having spacers fixedly received in the other one, wherein the jaws are mounted between the two side plates, the side plates holding the jaws and the middle lever together;

one of said spacers defining a central spacer being placed in a center of the head of the middle lever and through an opening in each said jaws;

said middle lever having a rotational axis defined by the central spacer;

said jaws having flat gripping surface capable to engage a range of sizes of fastener elements; and wherein the said middle lever moves the jaws by the means of two pins operably coupled to said jaws, the pins placed one on each face of the middle lever coincident to said longitudinal axis and equally distanced to the rotational axis, each of said pins engaging a respective hole in each of said jaws.

2. A device according to the claim 1 where said jaws move in opposite directions, inward and outward, simultaneously, when the said middle lever is rotated forwards and backwards around of its rotational axis.

* * * * *